US006032624A

United States Patent [19]

Tsuruta et al.

[11] Patent Number: 6,032,624

[45] Date of Patent: Mar. 7, 2000

[54] ENGINE VALVE ACTUATING DEVICES

[75] Inventors: Seiji Tsuruta; Takanori Sawada, both of Kanagawa, Japan

[73] Assignee: Unisia Jecs Corporation, Atsugi, Japan

[21] Appl. No.: 09/202,213

[22] PCT Filed: May 18, 1998

[86] PCT No.: PCT/JP98/02169

§ 371 Date: Dec. 10, 1998

§ 102(e) Date: Dec. 10, 1998

[30] Foreign Application Priority Data

May 19, 1997 [JP] Japan ..... 9-128730

[51] Int. Cl.[7] ..... F01L 13/00

[52] U.S. Cl. ..... 123/90.16; 123/90.22; 123/90.4

[58] Field of Search ..... 123/90.15, 90.16, 123/90.17, 90.22, 90.39, 90.4, 90.44

[56] References Cited

U.S. PATENT DOCUMENTS 5,085,182 2/1992 Nakamura et al. ..... 123/90.16
5,159,905 11/1992 Sugiuchi et al. ..... 123/90.16
5,613,469 3/1997 Rygiel ..... 123/90.16
5,794,576 8/1998 Hara et al. ..... 123/90.16

FOREIGN PATENT DOCUMENTS 3-43612 2/1991 Japan .
4-72403 3/1992 Japan .
5-14159 2/1993 Japan .
6-73301 10/1994 Japan .

*Primary Examiner*—Weilun Lo
*Attorney, Agent, or Firm*—Foley & Lardner

[57] ABSTRACT

Integrally formed with each other are a first engaging portion 20A and second engaging portion 20B of a connecting member 20 that are rotatably supported by a support shaft 24 disposed below a rocker arm 10. The engaging portions 20A and 20B are formed to selectively engage with cavities 12B and 14B of a first sub-rocker arm 12 and second sub-rocker arm 14. Therefore, a reduction in size of a selectively connecting mechanism can be achieved.

7 Claims, 11 Drawing Sheets

ENGINE VALVE ACTUATING DEVICES

TECHNICAL FIELD

The present invention relates to engine valve actuating devices that can switch the valve-lift characteristic in three steps in accordance with the engine operating state.

BACKGROUND ART

Regarding a conventional engine valve actuating device, there is known a device as described, for example, in a document of JP-A 4-72403. The outline will be described. A rocker arm for opening and closing an intake valve or an exhaust valve is swingably supported by a rocker shaft, and two sub-rocker arms are arranged on the same axis as the rocker shaft and in parallel, which come in slide contact with low-speed and high-speed cams in the engine operating state, respectively. Moreover, a selectively connecting mechanism is arranged for selectively connecting said two sub-rocker arms to the rocker shaft.

Said selectively connecting mechanism is provided with a connecting plunger arranged in the rocker shaft along its radial direction, and a hydraulic circuit for selectively supplying a working hydraulic pressure to the connecting plunger. When the connecting plunger is in engagement with a through hole of the sub-rocker arm by a working hydraulic pressure, the sub-rocker arm is in connection with the rocker shaft.

Moreover, when the connecting plunger is in non-engagement with the through hole of the sub-rocker arm, the sub-rocker arm is in non-connection with the rocker shaft.

In such selectively connecting mechanism, since one end of the connecting plunger arranged in the rocker arm is selectively engaged with the through hole of the sub-rocker arm, it is limited to set to a large value the diameter of the connecting plunger in the rocker shaft having a predetermined diameter due to a problem of the mechanical strength. Moreover, it is necessary to increase the accuracy of engagement of the outer peripheral surface of the connecting plunger with respect to the through hole of the sub-rocker arm. As a consequence, there arises a problem to fail to achieve an improvement in wear resistance of the connecting plunger and a sufficient reduction in manufacturing cost thereof.

Regarding an improvement proposal in such a case, as shown in JP-U 6-073301, in place of arranging the connecting plunger in the rocker shaft, one lever member as a connecting member and corresponding to each sub-rocker arm is rotatably supported by the rocker arm, and is disposed along the center axis of the rocker shaft, wherein when one end of each lever member is selectively in engagement with an engaged portion of the corresponding sub-rocker arm, the lift characteristic of an intake valve or an exhaust valve swung by the rocker arm is varied.

However, as described above, since one lever member as a connecting member and corresponding to each sub-rocker arm is rotatably supported by the rocker arm, and is disposed along the center axis of the rocker shaft, there is a limit to a relative reduction in the width of rocker shaft in the selectively connecting mechanism.

Taking account of the above problem, the present invention aims to provide engine valve actuating devices that can switch the valve-lift characteristic in three steps in accordance with the engine operating state, and that allow a reduction in size of a selectively connecting mechanism.

DISCLOSURE OF THE INVENTION

For achieving the above object, an engine valve actuating device relative to the present invention is provided with a camshaft having three cam portions with different cam-lift heights, which are arranged on the outer peripheral surface; a rocker arm having a base end that is rotatably supported to a rocker shaft and for opening and closing an engine valve in accordance with rotation of the first cam portion with the minimum cam-lift height; a first sub-rocker arm having a base that is disposed adjacent to the base end of said rocker arm and rotatably supported to the rocker arm, and swinging in accordance with rotation of said second cam portion with higher cam lift than the first cam portion; a second sub-rocker arm having a base that is disposed adjacent to the base end of said rocker arm and the base of the first sub-rocker arm and rotatably supported to the rocker arm, and swinging in accordance with rotation of the third cam portion with higher cam lift than the second cam portion; a connecting member having a first engaging portion for connecting, when engaged with the engaged portion arranged with the first sub-rocker arm, the first sub-rocker arm and the rocker arm so as to swing the first sub-rocker arm together with said rocker arm, and a second engaging portion integrally formed with the first engaging portion and for connecting, when engaged with the engaged portion arranged with the second sub-rocker arm, the second sub-rocker arm and the rocker arm and fist sub-rocker arm so as to swing the second sub-rocker arm together with said rocker arm and first sub-rocker arm; drive means for selectively putting the first engaging portion and second engaging portion of said connecting member in engagement or non-engagement with the engaged portions of the first sub-rocker arm and second sub-rocker arm; and a control part for making the drive means carry out, in accordance with said engine operating state, operation of selectively engaging the first engaging portion and second engaging portion of the connecting member with engaged portions of the first sub-rocker arm and second sub-rocker arm, respectively.

Further, the connecting member may be rotatably supported by the rocker arm substantially in the center along the center axis of the rocker shaft to be opposite to the first sub-rocker arm and second sub-rocker arm. Engaged portions of the first sub-rocker arm and second sub-rocker arm may be formed along the rotational direction of the connecting member, wherein the length of the engaged portion of the first sub-rocker arm along the rotational direction of the connecting member may be longer than the length of the engaged portion of the second sub-rocker arm along the rotational direction of the connecting member.

Furthermore, portions of the first engaging portion and second engaging portion of the connecting member engaged with the engaged portions of the first sub-rocker arm and second sub-rocker arm may be formed curvedly.

Resilient members may be disposed between the rocker arm and the first sub-rocker arm and between the rocker arm and the second sub-rocker arm in the directly connected way, respectively, for biasing the first sub-rocker arm and second sub-rocker arm along the swinging direction. The resilient members may positionally be restrained by engaging portions oppositely arranged between the rocker arm and the first sub-rocker arm and between the rocker arm and the second sub-rocker arm, respectively.

The drive means may comprise a first piston member for putting the first engaging portion of the connecting member in engagement with the engaged portion of the first sub-rocker arm by a working hydraulic pressure as supplied, a second piston member for putting the second engaging portion of the connecting member in engagement with the engaged portion of the second sub-rocker arm by a working hydraulic pressure as supplied, and a return-spring member for putting the first engaging portion and second engaging portion of the connecting member in non-engagement with the engaged portions of the first sub-rocker arm and second sub-rocker arm.

BEST MODE FOR CARRYING OUT THE INVENTION

Figure 1:
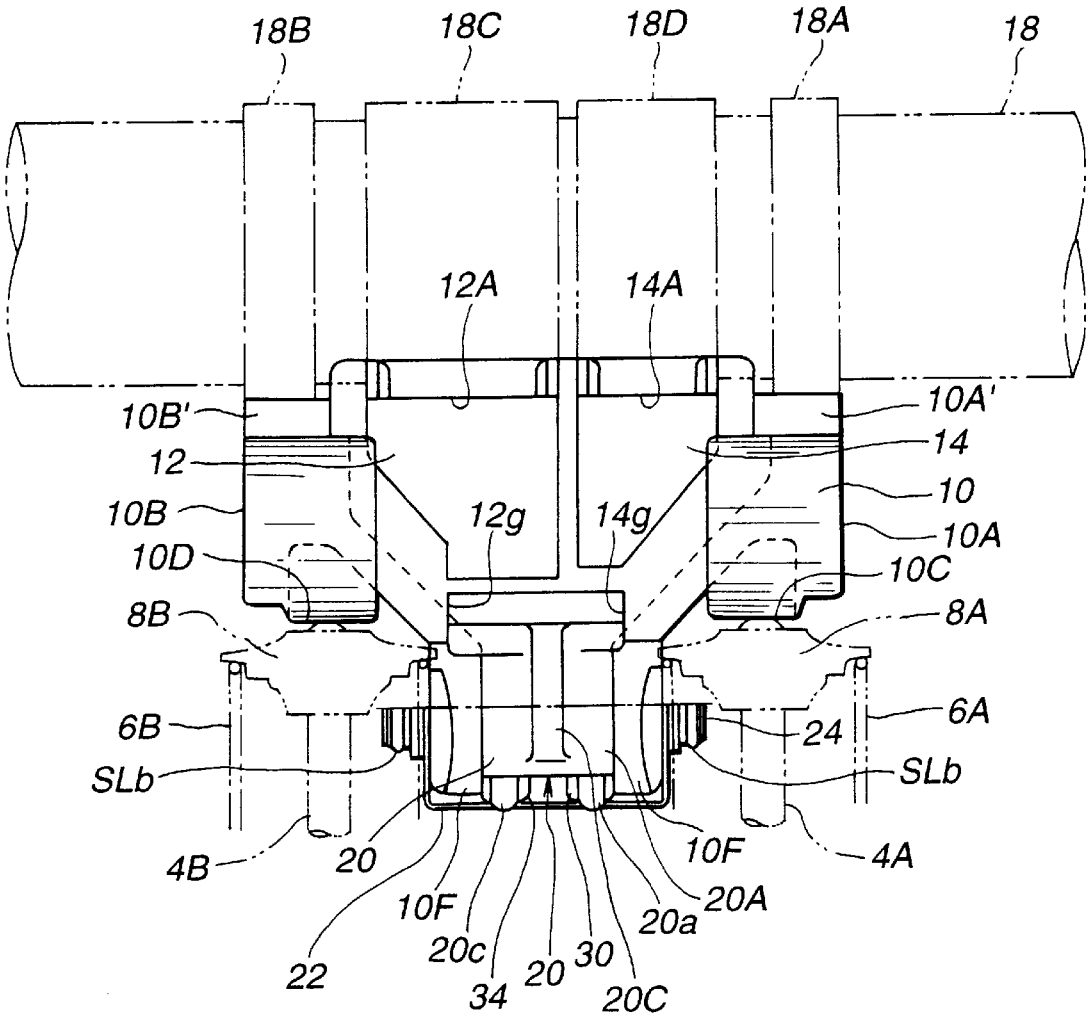
FIG. 1 is a front view showing the structure of a main part of an example of an engine valve actuating device according to the present invention.
Figure 2:
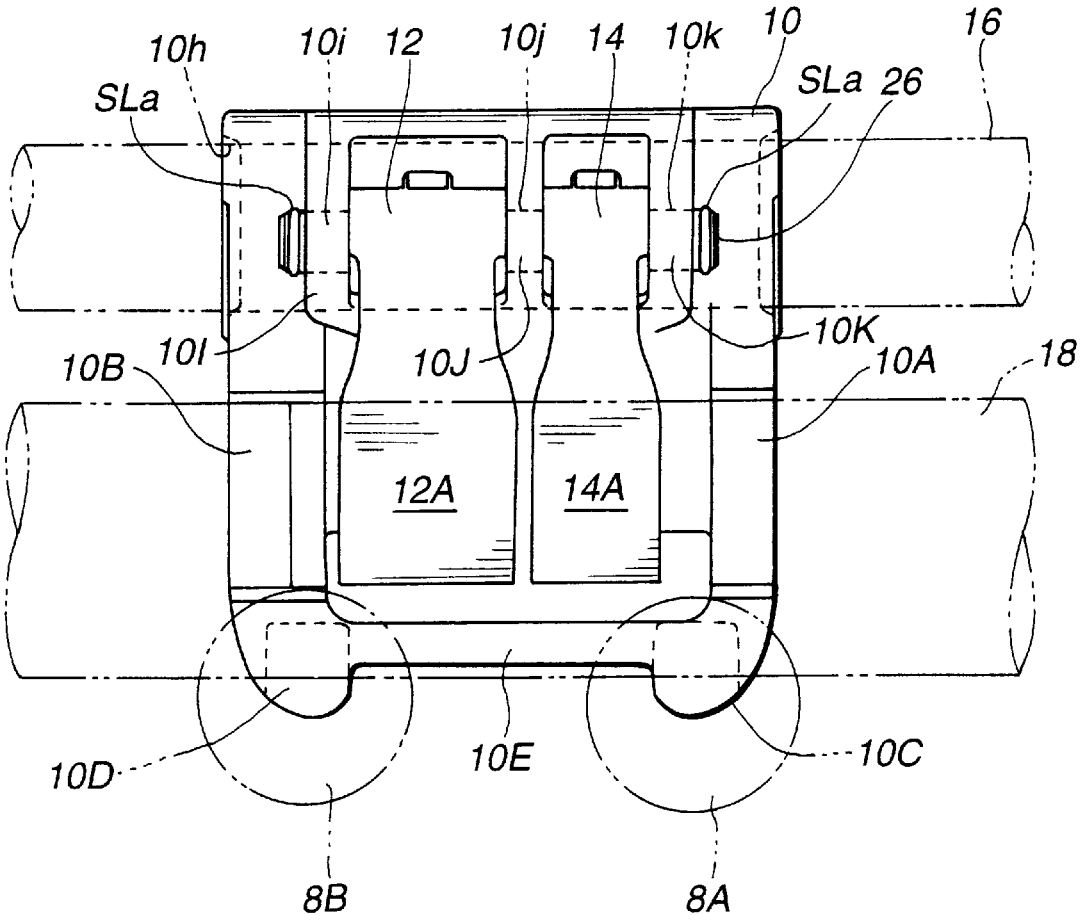
FIG. 2 is a plan view of the example as shown in FIG. 1.

FIGS. 1 and 2 show an embodiment of an engine valve actuating device according to the present invention.

An example as shown in FIGS. 1 and 2 shows the intake side of a valve mechanism arranged in a cylinder head in an engine main body whose illustration is omitted and corresponding to one of cylinders. Note that since the structure of the exhaust side of the valve mechanism is the same as that of the intake side thereof, its explanation will be omitted.

The driving method of the valve mechanism corresponds, for example, to an OHC (Over Head Camshaft) method wherein two intake valves corresponding to engine valves per cylinder are opened and closed.

The valve mechanism is provided with a substantially C-shaped rocker arm 10 having arm portions 10A and 10B contacting ends of valve stems of intake valves 8A and 8B and rotatably supported by a rocker shaft 16, first and second sub-rocker arms 12, 14 disposed in a middle position between the arm portions 10A and 10B of the rocker arm 10 and in parallel with each other, and a camshaft 18 disposed above the first and second sub-rocker arms 12, 14 and in parallel with the rocker shaft 16 and rotated together with a crankshaft of an engine main body.

Said rocker arm 10 is rotatably supported by the rocker shaft 16 engaged with a hole 10*h* arranged at the base end. Both ends of the rocker shaft 16 are supported by a cylinder head whose illustration is omitted.

Bearings 10I, 10J and 10K are arranged near the camshaft 18 than the hole 10*h* and at predetermined intervals along the axial direction of the rocker shaft 16.

A base of the first sub-rocker arm 12 is disposed between said bearing 10I and said bearing 10J, and a base of the second sub-rocker arm 14 is adjacently disposed between said bearing 10J and said bearing 10K. The bases of the sub-rocker arms 12, 14 are rotatably supported by support shafts 26 engaged with holes 12*a* and 14*a*, respectively, and are disposed on the same axis. The support shafts 26 are engaged with and supported by through holes 10*i*, 10*j* and 10*k* of the bearings 10I, 10J and 10K, respectively. Both ends of the support shafts 26 are engaged with the bearings 10I and 10K by snap rings SLa, respectively.

Arranged with both arm portions 10A, 10B of the rocker arm 10 in the positions opposite to the camshaft 18 are cam followers 10A' and 10B' with which cams 18A and 18B of the camshaft 18 come in slide contact. Arranged with a pointed end of the arm portion 10A and a pointed end of the arm portion 10B in the positions opposite to the intake valves 8A and 8B are contacts 10C and 10D that contact the ends of the valve stems of the intake valves 8A and 8B. Moreover, the pointed end of the arm portion 10A and the pointed end of the arm portion 10B are connected by a connection 10E.

The intake valves 8A and 8B are biased, as shown in FIG. 1, to the contacts 10C and 10D by biasing forces of coil springs 6A and 6B held by retainers arranged at ends of valve stems 4A and 4B, respectively.

Figure 4:
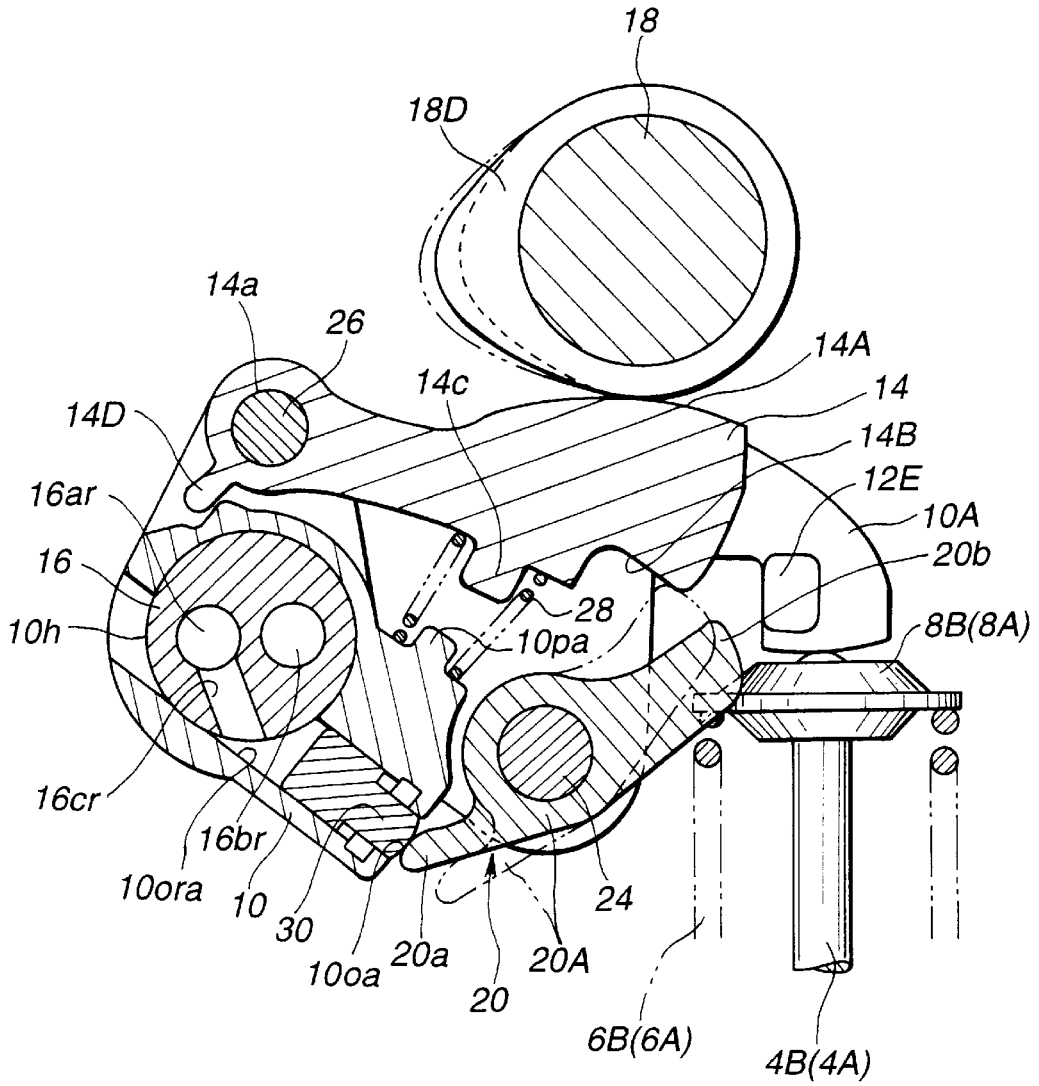
FIG. 4 is a sectional view for explaining operation of the example as shown in FIG. 1.

Arranged with said sub-rocker arm 14 on the upper side opposite to the camshaft 18 is a cam follower 14A that comes in slide contact with a cam 18D of the camshaft 18 as shown in FIG. 4. Arranged with the sub-rocker arm 14 on the lower side opposite to the cam follower 14A is a cavity 14B as an engaged portion with which an engaging portion 20A of a connecting lever 20 as will be described later is engaged. The cavity 14B has, along the axial direction of the support shaft 26, one end open, and another end with which a wall surface 14*g* substantially perpendicular to the axial direction of the support shaft 26 is formed.

Arranged with the lower side connecting said cavity 14B is an engaging portion 14C for carrying out positioning of a coil spring 28 as a resilient member disposed between the rocker arm 10 and the sub-rocker arm 14. Both ends of the coil spring 28 are positionally restrained by engaging portions 10*pa* of the rocker arm 10 disposed opposite to the engaging portion 14C and the engaging portion 14C and inserted in the inner periphery. The coil spring 28 serves to bias the sub-rocker arm 14 to the camshaft 18.

In such a way, the coil spring 28 has not a structure of being disposed inside the rocker arm 10 through a holder for accommodating the coil spring 28 as in the prior art, so that a frictional force between the holder and the inside of the rocker arm 10 is cancelled. Therefore, this results in a reduction in the number of parts and a simplification of machining of a receiver of the coil spring 28 of the rocker arm 10. Moreover, in case that the engaging portion 14C and the engaging portion 10*pa* come in contact with each other, an impulsive shearing force against the coil spring 28 is avoided.

A protruding lug 14D is arranged with the base of the second sub-rocker arm 14 on the side of the rocker shaft 16. And when the protruding lug 14D is engaged with a step of the engagement hole 10*h* of the rocker arm 10 at the outer periphery, more than a predetermined rise of the pointed end of the sub-rocker arm 14 is restrained.

Figure 5:
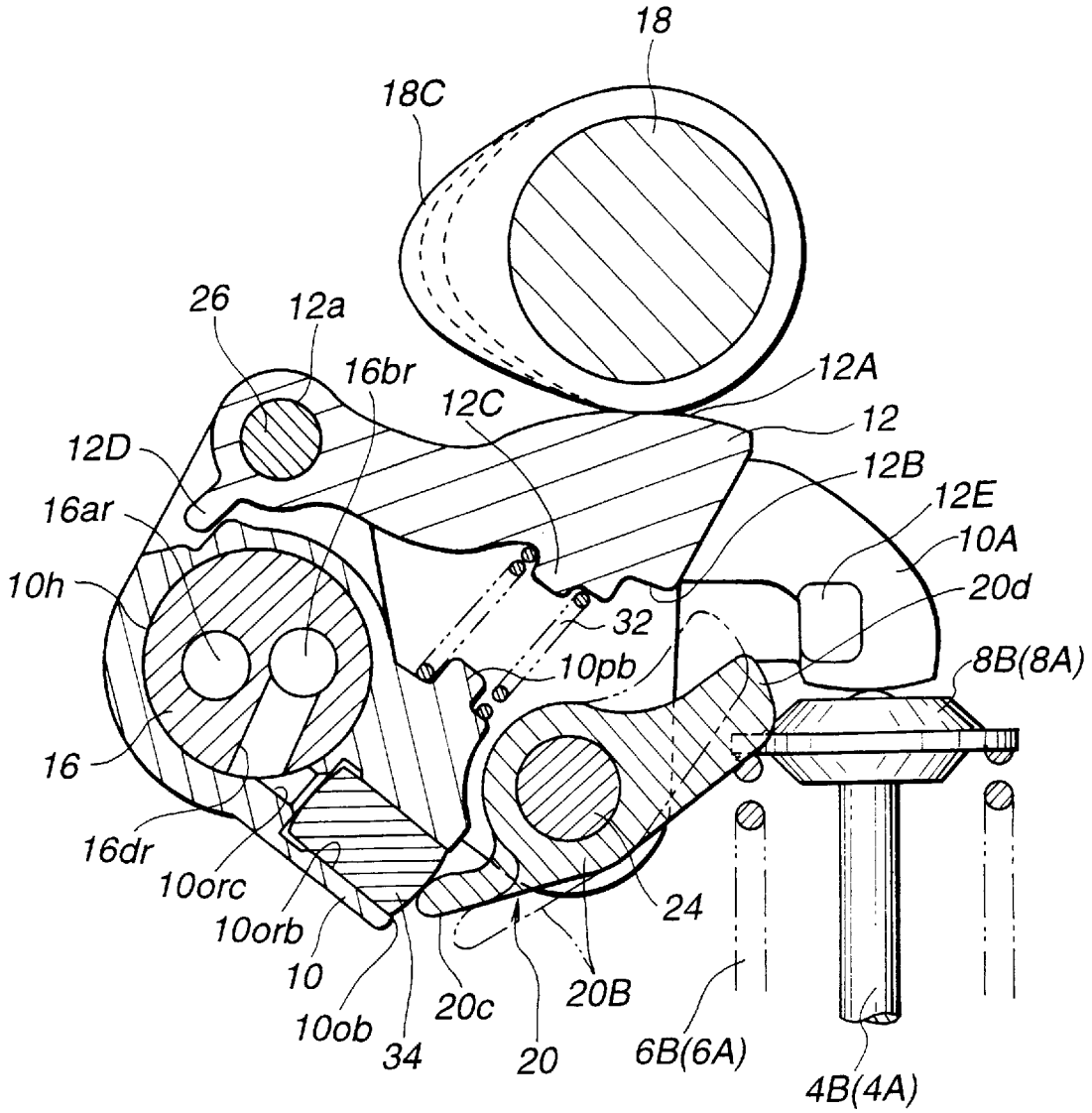
FIG. 5 is a sectional view for explaining operation of the example as shown in FIG. 1.

Moreover, arranged with the sub-rocker arm 12 on the upper side opposite to the camshaft 18 is a cam follower 12A that comes in slide contact with a cam 18C of the camshaft 18 as shown in FIG. 5. Arranged with the sub-rocker arm 12 on the lower side opposite to the cam follower 12A is a cavity 12B as an engaged portion with which an engaging portion 10B of the connecting lever 20 as will be described later is engaged. The length of the cavity 12B along the rotational direction of the engaging portion 20B of the connecting lever 20 is shorter than that of the cavity 14B. The cavity 12B has, along the axial direction of the support shaft 26, one end open, and another end with which a wall surface 12*g* substantially perpendicular to the axial direction of the support shaft 26 is formed.

Arranged with the lower side connecting the cavity 12B is an engaging portion 12C for carrying out positioning of a coil spring 32 disposed between the rocker arm 10 and the sub-rocker arm 12. Both ends of the coil spring 32 are positionally restrained by engaging portions 10*pb* of the rocker arm 10 disposed opposite to the engaging portion 12C and the engaging portion 12C. The coil spring 32 serves to bias the sub-rocker arm 12 to the camshaft 18.

In such a way, the coil spring 32 has not a structure of being disposed inside the rocker arm 10 through a holder for accommodating the coil spring 32 as in the prior art, so that a frictional force between the holder and the inside of the rocker arm 10 is cancelled. Therefore, this results in a reduction in the number of parts and a simplification of machining of a receiver of the coil spring 32 of the rocker arm 10. Moreover, in case that the engaging portion 12C and the engaging portion 10*pb* come in contact with each other, an impulsive shearing force against the coil spring 32 is avoided.

A protruding lug 12D is arranged with the base end of said second sub-rocker arm 12 on the side of the rocker shaft 16. When the protruding lug 12D is engaged with the step of the engagement hole 10*h* of the rocker arm 10 at the outer periphery, more than a predetermined rise of the pointed end of the sub-rocker arm 14 is restrained.

Arranged with said camshaft 18 along the axial direction and opposite to the cam followers 10A' and 10B', respectively, are the cams 18A and 18B for setting the minimum lift amounts of the intake valves 8A and 8B when an engine main body is in the low-speed operating state. Moreover, arranged between the cam 10A and the cam 18B along the axial direction and opposite to the cam follower 14A of the sub-rocker arm 14 and the cam follower 12A of the sub-rocker arm 12 are the second cam 18D and the third cam 18C for setting the lift amounts of the intake valve 8A and the intake valve 8B when the engine main body is in the medium-speed operating state or in the high-speed operating state.

The maximum eccentric amounts of the cam 18A and 18B with respect to the axis of the camshaft 18 are smaller than the maximum eccentric amount of the cam 18D. The maximum eccentric amount of the cam 18D is smaller than that of the cam 18C. That is, a variable valve timing mechanism whose illustration is omitted is arranged at one end of the camshaft 18.

Disposed in the lower portion of the rocker arm 10 substantially in the center opposite to the two sub-rocker arms 12, 14 is a support shaft 24 substantially in parallel with the camshaft 18 and the rocker shaft 16 as shown in FIGS. 1 and 4. The support shaft 24 has both ends supported by bearings 10F opposite to each other with a clearance and engaged with the bearings 10F by snap rings SLb, respectively.

The connecting lever 20 is rotatably supported by the support shaft 24. The connecting lever 20 has a second engaging portion 20B selectively engaged with the cavity 12B of the sub-rocker arm 12, and a first engaging portion 20A selectively engaged with the cavity 14B of the sub-rocker arm 14. The second engaging portion 20B and the first engaging portion 20A are disposed along the axis of the support shaft 20, and are integrally formed with each other. The first engaging portion 20A is arranged to separate from the second engaging portion 20B to the rocker shaft 16 by a predetermined angle along the rotational direction of the connecting lever 20.

Therefore, when substantially a half of an end 20*b* of the first engaging portion 20A passes from a position given by fully drawn line in FIG. 4 to an engagement position given by two-dot chain line, the engaging portion 20B is rotated from a position given by fully drawn line in FIG. 5 to a position given by two-dot chain line.

The one end 20*b* of the first engaging portion 20A is formed curvedly for obtain smooth engagement when being in the engaged state. Likewise, one end 20*d* of the engaging portion 20B is formed curvedly for obtain smooth engagement when being put in the engaged state.

As shown in FIG. 1, arranged with the connecting lever 20 is a return spring 22 having a middle portion engaged with a lower end of the connecting lever 20 and both end portions wound on both ends of the support shaft 24, respectively. The return spring 22 biases the engaging portions 20A and 20B of the connecting lever 20 in the direction of separating from the sub-rocker arms 12 and 14.

Formed inside the rocker shaft 16 are hydraulic passages 16*ar* and 16*br* extending in parallel with each other and along the center axes thereof as shown in FIGS. 4 and 5. The hydraulic passages 16*ar* and 16*br* are connected to a hydraulic circuit as will be described later. Formed with the rocker arm 10 in a portion opposite to the engaging portion 20A of the connecting lever 20 of the rocker shaft 16 is a pressure chamber 10*ora* communicating with the hydraulic passage 16*ar* through a communicating passage 16*cr*. A piston member 30 is slidably disposed in the pressure chamber 10*ora*.

When being supplied with a working hydraulic pressure via said hydraulic passage 16*ar* and said communicating passage 16*cr*, a pointed end of the piston member 30 is moved to protrude outside through one open end 10*oa* of the pressure chamber 10*ora*. By this, an end 20*a* of the engaging portion 20A is pressed, so that the connecting lever 20 is rotated counterclockwise, i.e. to the sub-rocker arm 14.

On the other hand, when being supplied with no working hydraulic pressure via the hydraulic passage 16*ar* and the communicating passage 16*cr*, the connecting lever 20 is rotated clockwise by a biasing force of the return spring 22, so that the pointed end of the piston member 30 is pressed by the end 20*a* of the engaging portion 20A to correspond to an end face of the rocker arm 10 given by fully drawn line in FIG. 4.

Formed with the rocker arm 10 in a portion opposite to the engaging portion 20B of the connecting lever 20 of the rocker shaft 16 is a pressure chamber 10*orb* communicating with the hydraulic passage 16*br* through a communicating passage 16*dr* as shown in FIG. 5. A piston member 34 is slidably disposed in the pressure chamber 10*orb*. When being supplied with a working hydraulic pressure via the hydraulic passage 16*br* and the communicating passage 16*dr*, a pointed end of the piston member 34 is moved to protrude outside through one open end 10*ob* of the pressure chamber 10*orb*. By this, an end 20*c* of the engaging portion 20B is pressed, so that the connecting lever 20 is rotated counterclockwise, i.e. to the sub-rocker arm 12.

On the other hand, when being supplied with no working hydraulic pressure via the hydraulic passage 16*br* and the communicating passage 16*dr*, the connecting lever 20 is rotated clockwise by a biasing force of the return spring 22, so that the pointed end of the piston member 30 is pressed by the end 20*c* of the engaging portion 20B to correspond to the end face of the rocker arm 10 given by fully drawn line in FIG. 4.

Figure 3:
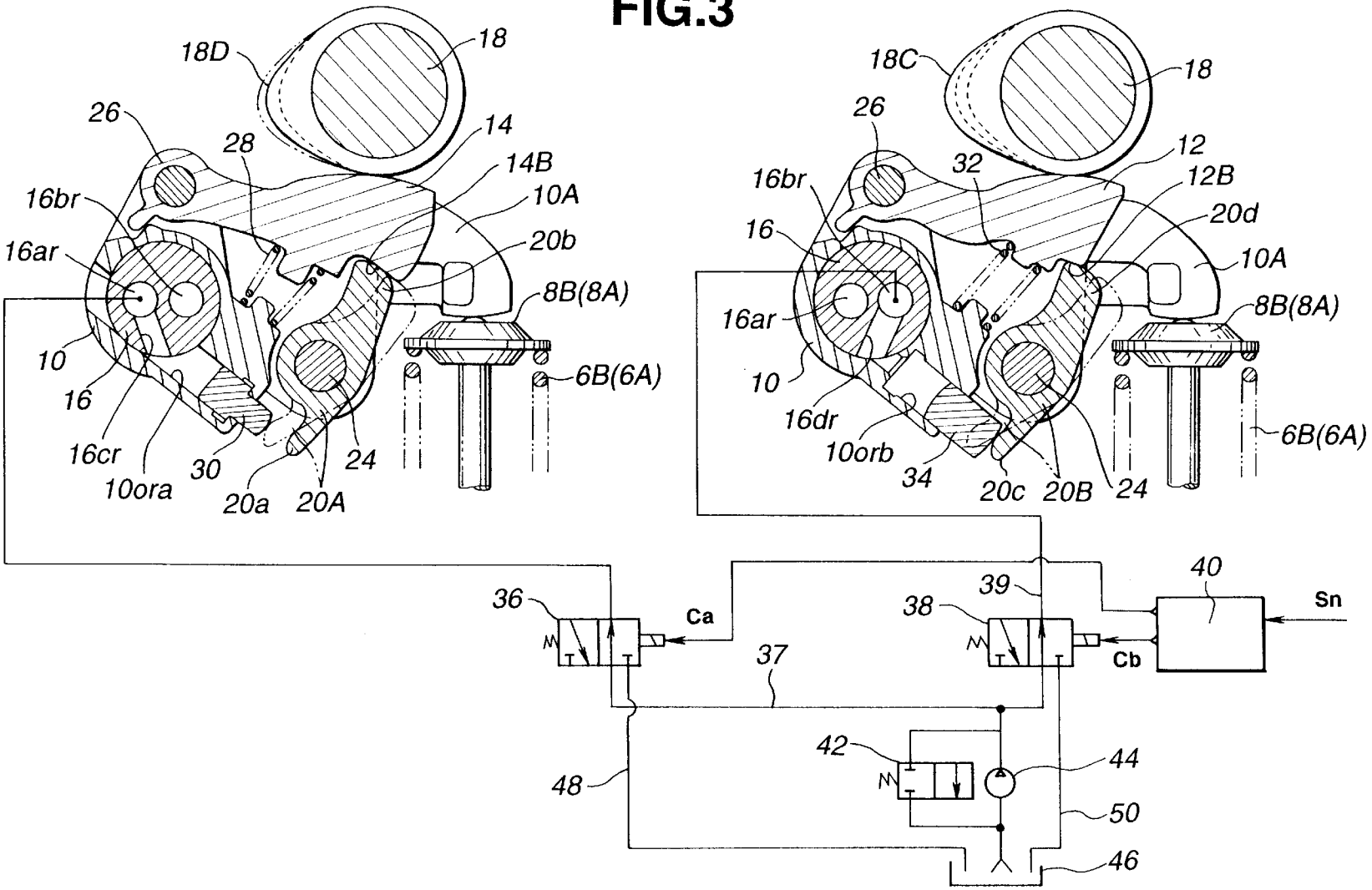
FIG. 3 is a circuit diagram showing the general structure of a hydraulic circuit provided in an example of an engine valve actuating device according to the present invention.

In one example of a valve actuating device according to the present invention, there are provided in addition as shown in FIG. 3 the hydraulic circuit for supplying a working hydraulic pressure to the pressure chambers 10*ora* and 10*orb* of the rocker arm 10 and a control part 40 for carrying out operation control of the hydraulic circuit in accordance with the operating state of the engine main body.

The hydraulic circuit is provided with hydraulic passages 37 and 38 having one ends both connected to the discharge side of a pump 44 for supplying working oil accumulated in an oil pan 46 and another ends connected to the hydraulic passages 16*ar* and 16*br*, respectively, a solenoid valve 36 arranged with the hydraulic passage 37 for selectively supplying working oil to the hydraulic passage 16*ar*, and a solenoid valve 38 arranged with the hydraulic passage 39 for selectively supplying working oil to the hydraulic passage 16*br*.

The solenoid valves 36 and 38 are normally closed three-port solenoid valves, respectively, which are put in the open state, respectively, when control signals Ca and Cb are supplied from the control part 40.

One input ports of the solenoid valves 36 and 38 are connected to the oil pan 46 through return hydraulic passages 48 and 50, respectively.

The discharge and intake sides of the pump 44 are connected to each other through a relief valve 42. The relief valve 42 has a known structure, and serves to reduce a line pressure by automatically returning working oil to the oil pan 46 when a line pressure in the hydraulic circuit becomes greater than a predetermined value. Note that FIG. 3 shows a case where the engine operating state corresponds to the high-speed operating state.

Supplied to the control part 40 is a detected output signal Sn indicating the engine speed and derived from an engine-speed sensor disposed in connection with a crankshaft of the engine main body.

When determining that the engine operating state corresponds to the low-speed operating state based on the detected output signal Sn, the control part 40 does not supply the control signals Ca and Cb to the solenoid valves 36 and 38.

By this, a working hydraulic pressure is not supplied to the hydraulic passages 16*ar* and 16*br* via the hydraulic passages 37 and 39, so that the pointed end of the piston members 30 and 34 do not protrude outside. Moreover, the engaging portions 20A and 20B of the connecting lever 20 are put in non-engagement with the cavities 12B and 14B of the sub-rocker arms 12 and 14 as shown in FIGS. 4 and 5.

Therefore, the rocker arm 10 and sub-rocker arm 12, and the rocker arm 10 and sub-rocker arm 14 are put in the non-connected state, so that swing motion of the sub-rocker arm 14 swung by the cam 18D for medium speed is absorbed by the coil spring 28, and swing motion of the sub-rocker arm 12 swung by the cam 18C for high speed is absorbed by the coil spring 32.

On the other hand, the rocker arm 10 swung by the cams 18A and 18B for low speed makes the intake valves 8A and 8B carry out opening and closing motion at a predetermined timing set by the variable valve timing mechanism.

Figure 10:
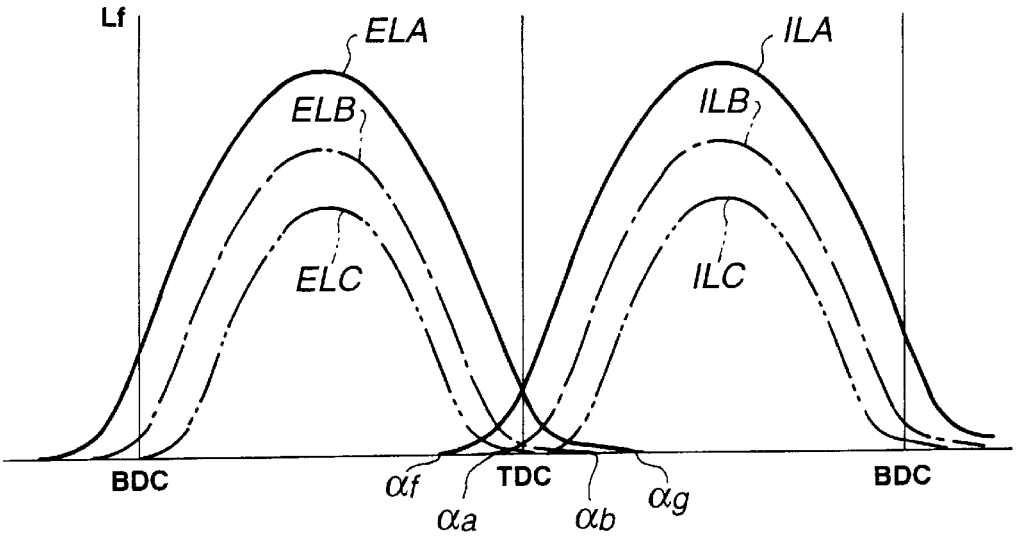
FIG. 10 is a characteristic view for explaining operation of the example as shown in FIG. 1.

The lift amounts of the intake valves 8A and 8B, the lift amounts of the exhaust valves whose illustration is omitted, and the overlap period of the intake valves 8A and 8B and the exhaust valves are controlled, in the normal engine operation mode, in the opening and closing way and in accordance with, e.g. characteristic lines ILC and ELC given by two-dot chain lines in FIG. 10. Plotting in the horizontal axis the angle of rotation of the cam indicating the positions such as top dead center (TDC) and bottom dead center (BDC), and in the vertical axis the lift amount Lf, FIG. 10 shows the lift amounts of the intake valves 8A and 8B, the lift amounts of the exhaust valves whose illustration is omitted, and the overlap period of the intake valves 8A and 8B and the exhaust valves.

The characteristic lines ILC and ELC as shown in FIG. 10 do not overlap each other at a point in the vicinity of the top dead center.

Figure 11:
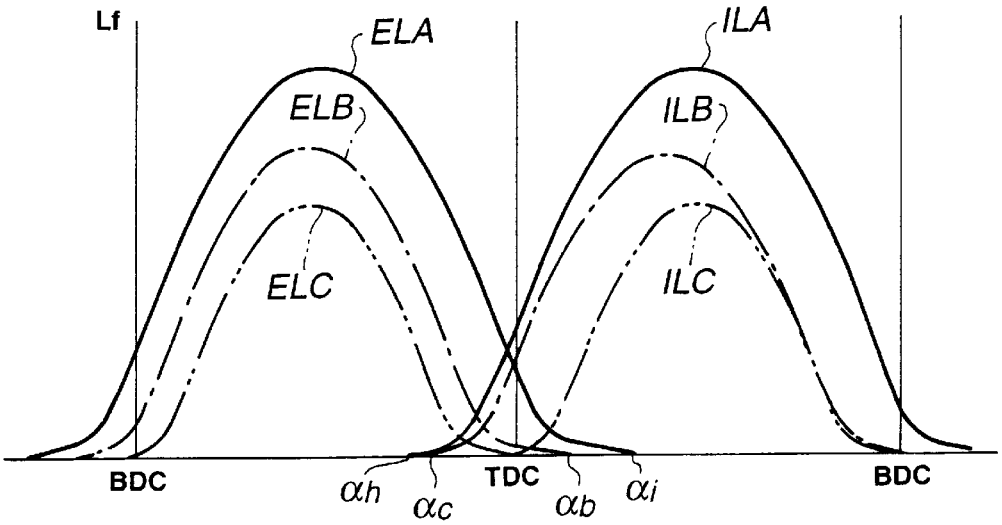
FIG. 11 is a characteristic view for explaining operation of the example as shown in FIG. 1.

Moreover, in the first operation mode taken in case that a predetermined condition of the engine operating state is formed, they are controlled in the opening and closing way and in accordance with characteristic lines ILC and ELC given by two-dot chain lines in FIG. 11. Plotting in the horizontal axis the angle of rotation of the cam indicating the positions such as top dead center (TDC) and bottom dead center (BDC), and in the vertical axis the lift amount Lf, FIG. 11 shows the lift amounts of the intake valves 8A and 8B, the lift amounts of the exhaust valves whose illustration is omitted, and the overlap period of the intake valves 8A and 8B and the exhaust valves. The characteristic lines ILC and ELC as shown in FIG. 11 also do not overlap each other at a point in the vicinity of the top dead center.

Figure 12:
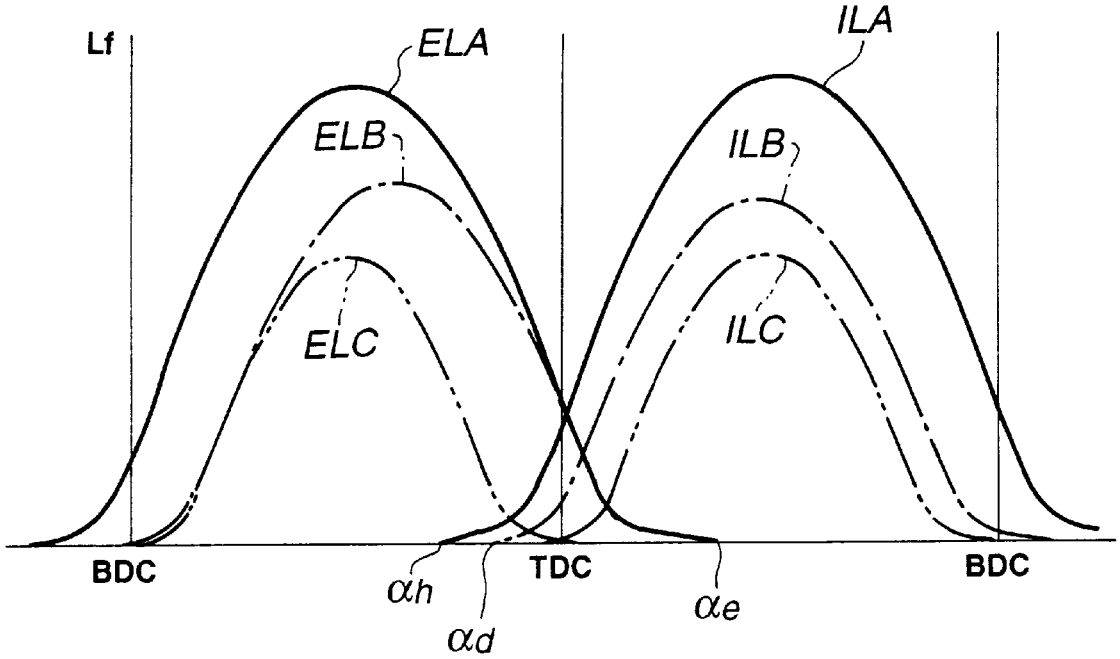
FIG. 12 is a characteristic view for explaining operation of the example as shown in FIG. 1.

Moreover, in the second operation mode taken in case that a predetermined condition of the engine operating state is formed, they are controlled in the opening and closing way and in accordance with characteristic lines ILC and ELC given by two-dot chain lines in FIG. 12. Plotting in the horizontal axis the angle of rotation of the cam indicating the positions such as top dead center (TDC) and bottom dead center (BDC), and in the vertical axis the lift amount Lf, FIG. 12 shows the lift amounts of the intake valves 8A and 8B, the lift amounts of the exhaust valves whose illustration is omitted, and the overlap period of the intake valves 8A and 8B and the exhaust valves. The characteristic lines ILC and ELC as shown in FIG. 12 slightly overlap each other at a point in the vicinity of the top dead center.

Next, when determining that the engine operating state corresponds to the medium-speed operating state based on the detected output signal Sn, the control part 40 supplies the control signal Ca to the solenoid valve 36 and does not supply the control signal Cb to the solenoid valve 38.

Figure 6:
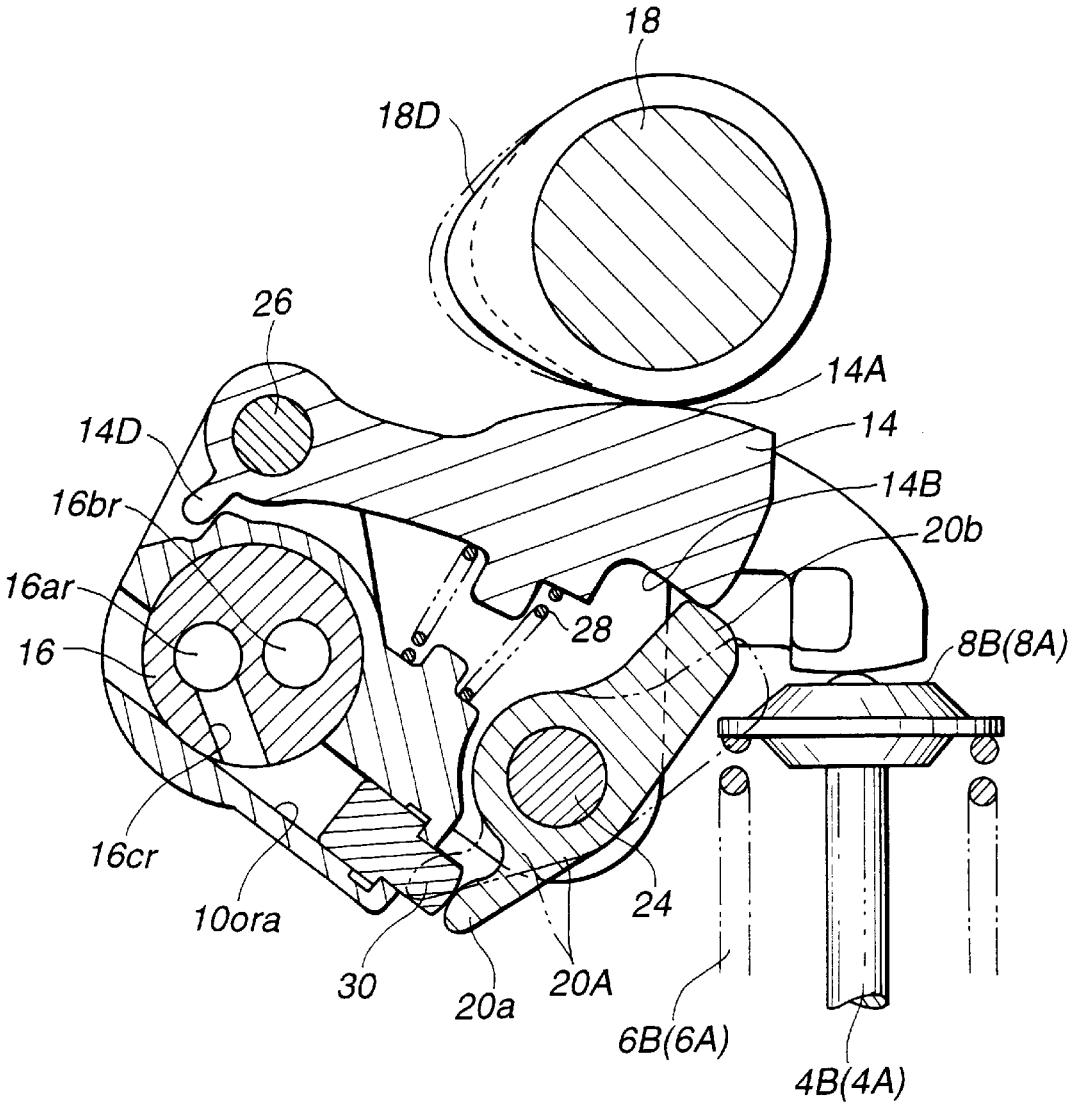
FIG. 6 is a sectional view for explaining operation of the example as shown in FIG. 1.
Figure 7:
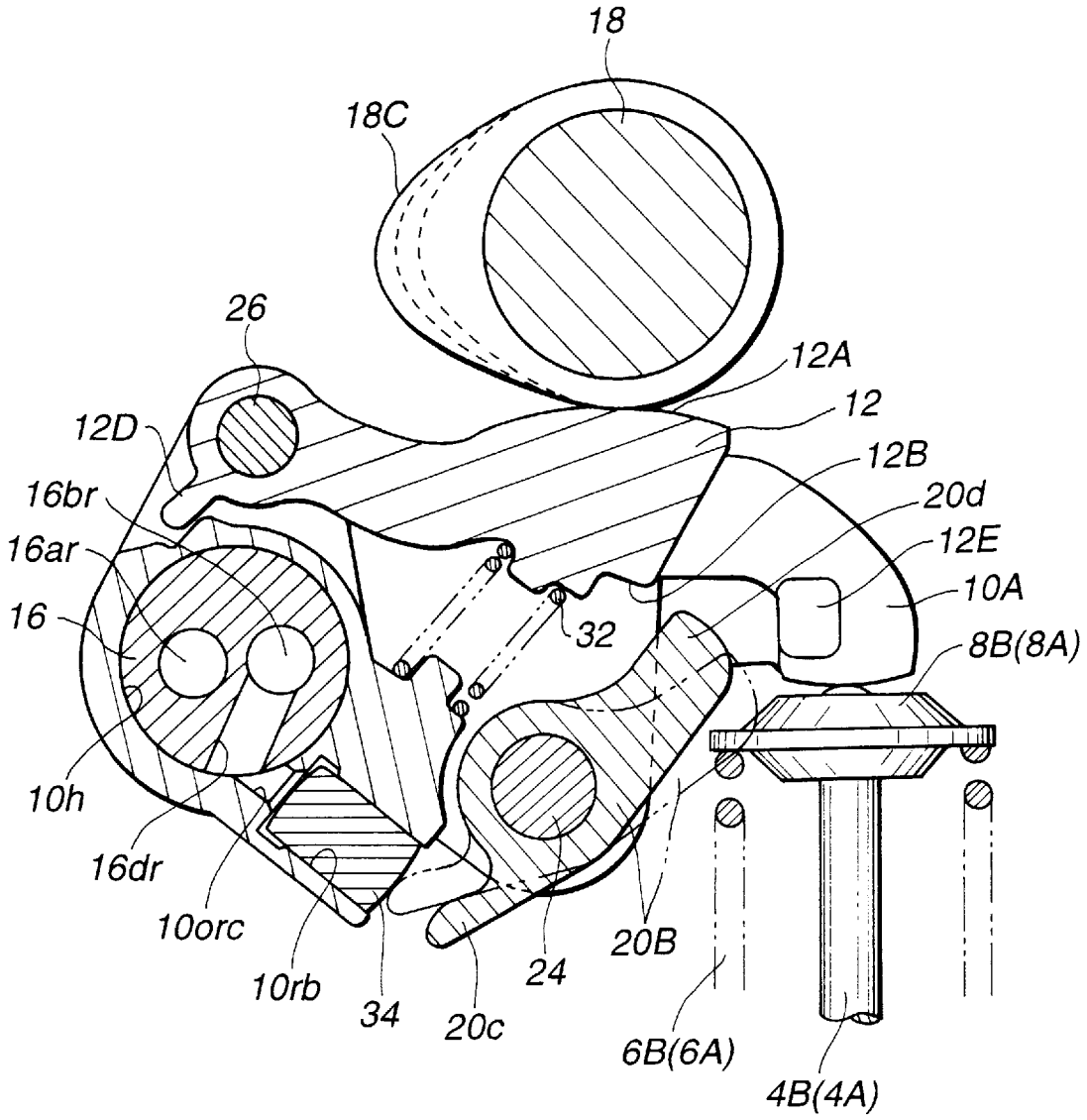
FIG. 7 is a sectional view for explaining operation of the example as shown in FIG. 1.

By this, a working hydraulic pressure is supplied by the pump 44 to the hydraulic passage 16*ar* via the hydraulic passage 37 and is not supplied to the hydraulic passage 16*br*, so that the pointed end of the piston member 30 protrudes outside to rotate the engaging portion 20A from the position given by two-dot chain lines to the position given by fully drawn lines as shown in FIGS. 6 and 7, and the pointed end of the piston member 34 does not protrude outside.

At that time, the engaging portion 20B of the connecting lever 20 is put in non-engagement with the cavity 12B of the sub-rocker arm 12, and substantially a half of the end 20*b* of the engaging portion 20A of the connecting lever 20 is put in engagement with the cavity 14B of the sub-rocker arm 14.

Therefore, the rocker arm 10 and the sub-rocker arm 14 are put in the connected state, and the rocker arm 10 and the sub-rocker arm 12 are put in the non-connected state, so that the sub-rocker arm 10 swung in accordance with the lift amount of the sub-rocker arm 14 swung by the cam 18D for medium speed carries out opening and closing motion of the intake valves 8A and 8B at a predetermine timing. Moreover, swing motion of the sub-rocker arm 12 swung by the cam 18C for high speed is absorbed by the coil spring 32.

The lift amounts of the intake valves 8A and 8B, the lift amounts of the exhaust valves whose illustration is omitted, and the overlap period of the intake valves 8A and 8B and the exhaust valves are controlled, in the normal engine operation mode, in the opening and closing way and in accordance with, e.g. characteristic lines ILB and ELB given by one-dot chain lines in FIG. 10.

In the characteristic lines ILB and ELB as shown in FIG. 10, the section from an angle of rotation αa before the vicinity of the top dead center to an angle of rotation αb after the top dead center corresponds to the overlap period.

Moreover, in the first operation mode taken in case that a predetermined condition of the engine operating state is formed, they are controlled in the opening and closing way and in accordance with characteristic lines ILB and ELB given by one-dot chain lines in FIG. 11. In the characteristic lines ILB and ELB as shown in FIG. 11, the intake valves 8A and 8B begin to open at an angle of rotation αc earlier than said angle of rotation αa, and the exhaust valves close at said angle of rotation αb. By this, the section from the angle of rotation αa before the vicinity of the top dead center to the angle of rotation αb after the top dead center corresponds to the overlap period that is longer than that in the normal operation mode.

Moreover, in the second operation mode taken in case that a predetermined condition of the engine operating state is formed, they are controlled in the opening and closing way and in accordance with characteristic lines ILB and ELB given by one-dot chain lines in FIG. 12. In the characteristic lines ILB and ELB given by one-dot chain lines in FIG. 12, the intake valves 8A and 8B begin to open at an angle of rotation αd later than said angle of rotation αc and earlier than said angle of rotation αa, and the exhaust valves close at an angle of rotation αe later than said angle of rotation αb. By this, the section from the angle of rotation αd before the vicinity of the top dead center to the angle of rotation αe after the top dead center corresponds to the overlap period that is longer than that in the normal operation mode. In such a way, the exhaust valves are closed at the angle of rotation αe later than said angle of rotation αb, and thus a hydrocarbon (HC) component contained in exhaust gas is reduced efficiently.

Subsequently, when determining that the engine operating state corresponds to the high-speed operating state based on the detected output signal Sn, the control part 40 supplies the control signal Ca to the solenoid valve 36, and the control signal Cb to the solenoid valve 38.

Figure 8:
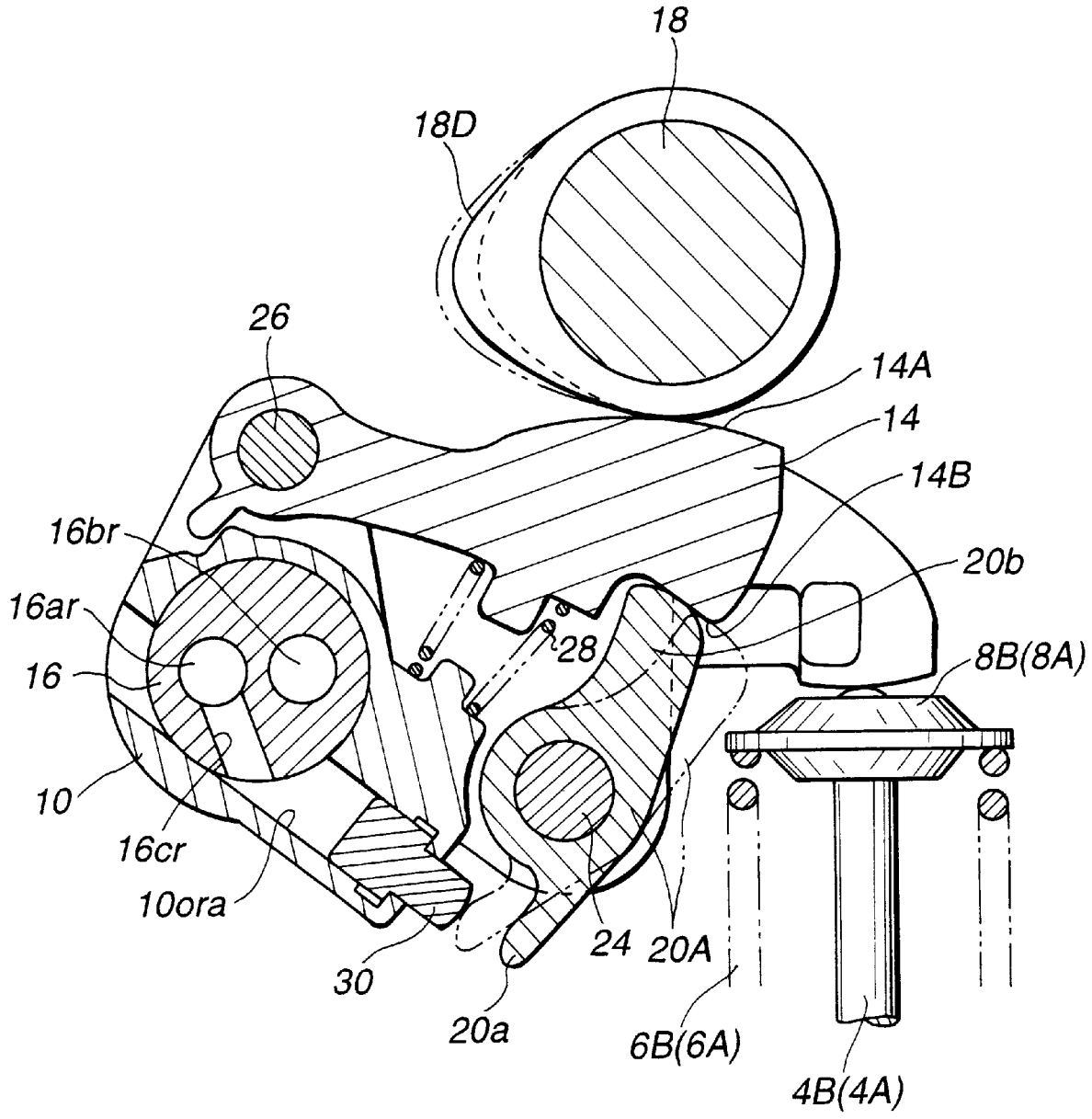
FIG. 8 is a sectional view for explaining operation of the example as shown in FIG. 1.
Figure 9:
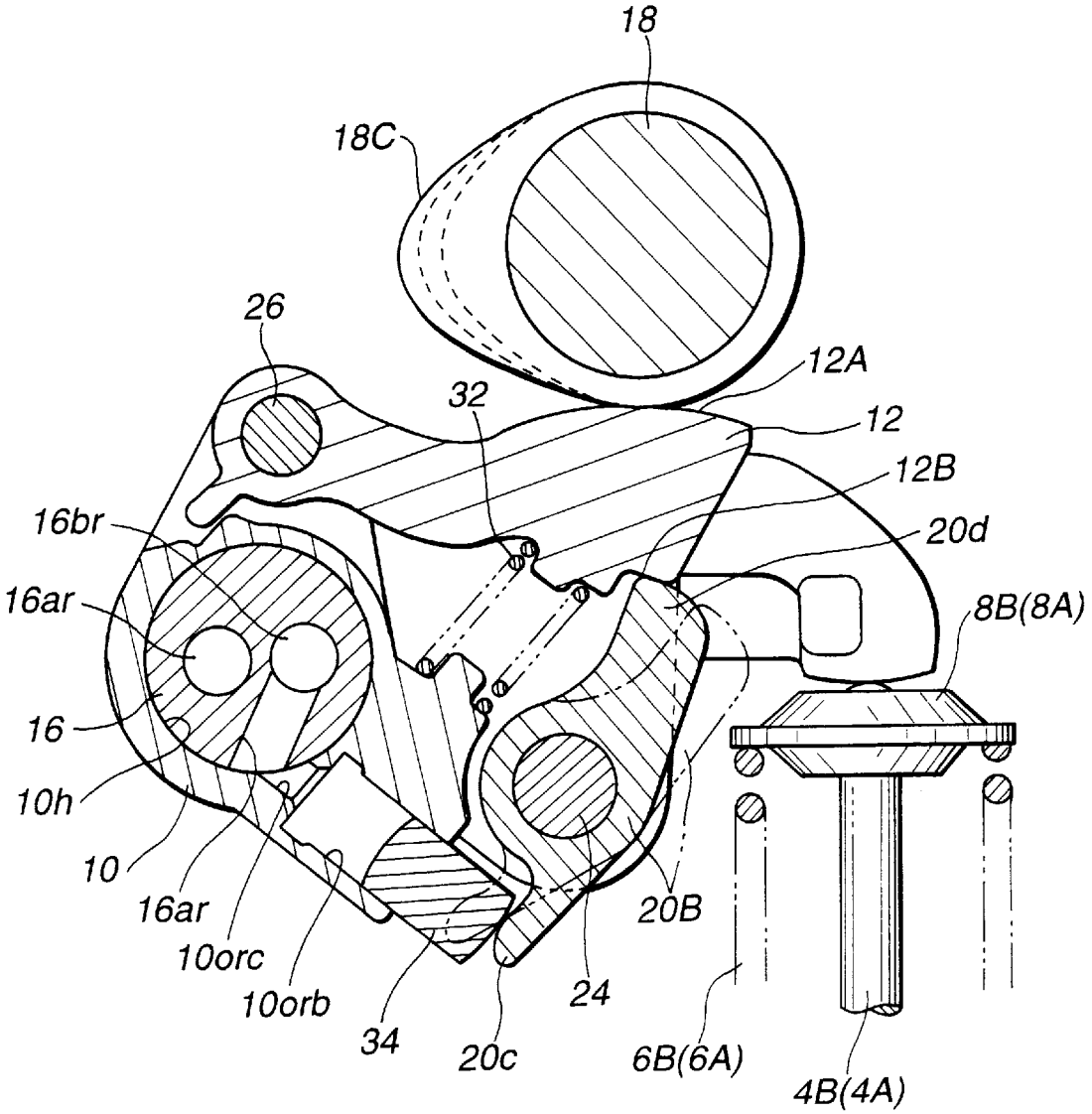
FIG. 9 is a sectional view for explaining operation of the example as shown in FIG. 1.

By this, a working hydraulic pressure is supplied by the pump 44 to the hydraulic passage 16*ar* via the hydraulic passage 37, and to the hydraulic passage 16*br* via the hydraulic passage 39, so that as shown in FIGS. 8 and 9, the pointed end of the piston member 34 protrudes outside, and the pointed end of the piston member 30 is retained protruding outside. As a consequence, the end 20*d* of the engaging portion 20B is rotated from the position given by two-dot chain line to the position given by fully drawn line to be engaged with the cavity 12B, by which the end 20*b* of the engaging portion 20A is further rotated from the position given by two-dot chain line to the position given by fully drawn line. The engaging portion 20B of the connecting lever 20 is put in engagement with the cavity 12B of the sub-rocker arm 12, and the entirety of the end 20*b* of the engaging portion 20A of the connecting lever 20 is put in engagement with the cavity 14B of the sub-rocker arm 14.

Therefore, the rocker arm 10 and sub-rocker arm 14, and the rocker arm 10 and sub-rocker arm 12 become in the connected state, so that the rocker arm 10 swung in accordance with the lift amount of the sub-rocker arm 12 swung by the cam 18C for high speed makes the intake valves 8A and 8B carry out opening and closing motion at a predetermined timing.

The lift amounts of the intake valves 8A and 8B, the lift amounts of the exhaust valves whose illustration is omitted, and the overlap period of the intake valves 8A and 8B and the exhaust valves are controlled, in the normal engine operation mode, in the opening and closing way and in accordance with, e.g. characteristic lines ILA and ELA given by fully drawn lines in FIG. 10. In the characteristic lines ILA and ELA as shown in FIG. 10, the section from an angle of rotation αf earlier than the angle of rotation αa before the top dead center to an angle of rotation αg later than the angle of rotation αb after the top dead center corresponds to the overlap period.

Moreover, in the first operation mode taken in case that a predetermined condition of the engine operating state is formed, they are controlled in the opening and closing way and in accordance with characteristic lines ILA and ELA given by fully drawn lines in FIG. 11. In the characteristic lines ILA and ELA as shown in FIG. 11, the intake valves 8A and 8B begin to open at an angle of rotation αh earlier than said angle of rotation αf, and the exhaust valves close at an angle of rotation αi later than said angle of rotation αg. By this, the section from the angle of rotation αh before the vicinity of the top dead center to the angle of rotation αb after the top dead center corresponds to the overlap period that is longer than that in the normal operation mode.

Moreover, in the second operation mode taken in case that a predetermined condition of the engine operating state is formed, they are controlled in the opening and closing way and in accordance with characteristic lines ILA and ELA given by fully drawn lines in FIG. 12. In the characteristic lines ILA and ELA given by fully drawn lines in FIG. 12, the intake valves 8A and 8B begin to open at said angle of rotation αh, and the exhaust valves close at the angle of rotation αe later than said angle of rotation αi. By this, the section from the angle of rotation αh before the vicinity of the top dead center to the angle of rotation αe after the top dead center corresponds to the overlap period that is longer than that in the normal operation mode.

Moreover, when the engine operating state passes from the high-speed operating state to the medium-speed operating state, the control part 40 stops supply of the control signal Cb to the solenoid valve 38. By this, a working hydraulic pressure within the pressure chamber 10*orb* is returned to the oil pan 46 via the hydraulic passage 50, so that only the rocker arm 10 and the sub-rocker arm 12 become in the connected state.

When the engine operating state passes from the high-speed or medium-speed operating state to the low-speed operating state, the control part stops supply of the control signals Ca and Cb to the solenoid valves 36 and 38. By this, the rocker arm 10 and sub-rocker arm 12, and the rocker arm 10 and sub-rocker arm 14 are put in the non-connected state.

As is clear from the above explanation, according to the engine valve actuating device relative to the present invention, the first engaging portion and second engaging portion of the connecting member are selectively put in engagement or in non-engagement with the engaged portions of the first sub-rocker arm and second sub-rocker arm by drive means to switch the valve lift characteristic, enabling easy reduction in size of the selectively connecting mechanism.

Industrial Applicability

The engine valve actuating device according to the present invention can be applied to the intake or exhaust side only, and, of course, to engines for vessels in addition to motor vehicles.

We claim:

1. An engine valve actuating device, characterized in that it is provided with:

a camshaft having three cam portions with different cam-lift heights, which are arranged on the outer peripheral surface of the camshaft;

a rocker arm having a base end that is rotatably supported on a rocker shaft and for opening and closing an engine valve in accordance with rotation of the first cam portion with the minimum cam-lift height;

a first sub-rocker arm having a base that is disposed adjacent to the base end of said rocker arm and rotatably supported on the rocker arm, and swinging in accordance with rotation of said second cam portion with higher cam lift than the first cam portion;

a second sub-rocker arm having a base that is disposed adjacent to the base end of said rocker arm and the base of the first sub-rocker arm and rotatably supported on the rocker arm, and swinging in accordance with rotation of the third cam portion with higher cam lift than the second cam portion;

a connecting member having a first engaging portion for connecting, when engaged with an engaged portion arranged on the first sub-rocker arm, the first sub-rocker arm and the rocker arm so as to swing the first sub-rocker arm together with said rocker arm, and a second engaging portion integrally formed with the first engaging portion and for connecting, when engaged with an engaged portion arranged on the second sub-rocker arm, the second sub-rocker arm and the rocker arm and the first sub-rocker arm so as to swing the second sub-rocker arm together with said rocker arm and first sub-rocker arm;

drive means for selectively putting the first engaging portion and second engaging portion of said connecting member in engagement or non-engagement with the engaged portions of the first sub-rocker arm and second sub-rocker arm; and a control part for making the drive means carry out, in accordance with said engine operating state, operation of selectively engaging the first engaging portion and second engaging portion of the connecting member with engaged portions of the first sub-rocker arm and second sub-rocker arm, respectively.

2. An engine valve actuating device as specified in claim 1, characterized in that said connecting member is rotatably supported by said rocker arm substantially in the center along the center axis of said rocker shaft to be opposite to said first sub-rocker arm and second sub-rocker arm.

3. An engine valve actuating device as specified in claim 2, characterized in that engaged portions of said first sub-rocker arm and second sub-rocker arm are formed along the rotational direction of said connecting member, wherein the length of the engaged portion of the first sub-rocker arm along the rotational direction of the connecting member is longer than the length of the engaged portion of the second sub-rocker arm along the rotational direction of the connecting member.

4. An engine valve actuating device as specified in claim 2, characterized in that portions of the first engaging portion and second engaging portion of said connecting member engaged with the engaged portions of said first sub-rocker arm and second sub-rocker arm are formed curvedly.

5. An engine valve actuating device as specified in claim 1, characterized in that resilient members are disposed between said rocker arm and said first sub-rocker arm and between the rocker arm and said second sub-rocker arm in the directly connected way, respectively, for biasing the first sub-rocker arm and second sub-rocker arm along the swinging direction.

6. An engine valve actuating device as specified in claim 5, characterized in that said resilient members are positionally restrained by engaging portions oppositely arranged between said rocker arm and said first sub-rocker arm and between the rocker arm and said second sub-rocker arm, respectively.

7. An engine valve actuating device as specified in claim 1, characterized in that said drive means comprise a first piston member for putting the first engaging portion of said connecting member in engagement with the engaged portion of said first sub-rocker arm by a working hydraulic pressure as supplied, a second piston member for putting the second engaging portion of the connecting member in engagement with the engaged portion of the second sub-rocker arm by a working hydraulic pressure as supplied, and a return-spring member for putting the first engaging portion and second engaging portion of the connecting member in non-engagement with the engaged portions of the first sub-rocker arm and second sub-rocker arm.

* * * * *